United States Patent [19]

Schläppi

[11] 4,043,116

[45] Aug. 23, 1977

[54] TIMEPIECE COMPRISING A FLAT DISPLAY DEVICE EXPOSED THROUGH AN OPENING IN A CASE

[75] Inventor: Hans Schläppi, Bettlach, Switzerland

[73] Assignee: Metallprodukte A.G. Grenchen, Grenchen, Switzerland

[21] Appl. No.: 653,367

[22] Filed: Jan. 29, 1976

[51] Int. Cl.[2] ..... G04B 19/06; G04B 37/00; G04B 39/00

[52] U.S. Cl. ..... 58/88 R; 58/91; 58/127 R

[58] Field of Search ..... 58/23 R, 50 R, 126 R, 58/126 A, 127 R, 127 B, 128, 88 R, 91

[56] References Cited

U.S. PATENT DOCUMENTS

| | | | |
|---|---|---|---|
| 3,078,364 | 2/1963 | Neugebauer | 58/50 R UX |
| 3,650,599 | 3/1972 | Pederson | 58/50 R X |
| 3,768,887 | 10/1973 | Portmann | 58/91 X |
| 3,783,603 | 1/1974 | Himmelsbach | 58/50 R |
| 3,786,626 | 1/1974 | Hurt | 58/127 R X |
| 3,854,278 | 12/1974 | Takeshita et al. | 58/50 R |
| 3,910,033 | 10/1975 | Saito | 58/127 R |
| 3,955,190 | 5/1976 | Teraishi | 58/50 R X |

OTHER PUBLICATIONS

T936,004, July 1975, Willis, 58/50 R.

*Primary Examiner*—Stanley J. Witkowski
*Attorney, Agent, or Firm*—Schroeder, Siegfried, Ryan & Vidas

[57] ABSTRACT

This invention relates to a timepiece having a flat display device exposed through an opening or openings in the case for the timepiece. The crystal mounted on the case and closing off the opening has two at least partially reflective surfaces enclosing between them an angle less than 45° with a third surface on the crystal through which the display device is visible by means of double reflection of the light from said at least two partially reflective surfaces. These surfaces are reflective either by a reflective plate surrounding the opening or by providing the upper surface of the case or the inner face of the crystal with a reflective coating. The display may also be viewed through the crystal from above.

8 Claims, 2 Drawing Figures

TIMEPIECE COMPRISING A FLAT DISPLAY DEVICE EXPOSED THROUGH AN OPENING IN A CASE

This invention relates to a timepiece comprising a case having an opening therein, an operating assembly disposed within the case, a flat display device exposed through the opening, and a crystal closing off the opening.

Ever since timepieces with digital displays have come to be marketed in ever-increasing numbers, in different sizes and shapes, especially in the form of wrist-watches, the problem of the positioning and appearance of the display device has presented itself under circumstances different from those encountered in the case of conventional timepieces having an analog display comprising hands rotating about an axis. Thus when such timepieces are wrist-watches, for example, they are generally rather thin and lie against the wearer's wrist. The surface area necessary for displaying the desired indications, usually the hour, minute, second, and date, remains smaller than the total surface area of the operating assembly housed within the case. This applies particularly to mechanical wrist-watches where the display device is a mechanism comprising rotating disks or rings of which parts appear in one or more apertures. It has already been proposed to design miniature clocks or wrist-watches in such a way that the indication displayed appears in another position and on another face of the case than that corresponding to the largest surface area of the operating assembly. Thus wrist-watches are already known in which the indication of the time is displayed by revolving drums visible in an inclined aperture situated at one end of the case. This arrangement makes it easier to see the time and obviates any necessity for the wearer to turn his wrist in order to do so. However, such an arrangement entails extensive changes in the construction of the movement, and numerous difficulties are encountered in putting these changes into practice.

It is an object of this invention to provide a simpler and more efficient solution to the problem outlined above.

To this end, in the timepiece according to the present invention, the crystal comprises two at least partially reflective surfaces enclosing between them an angle of less than 45°, and a third surface through which the display device is visible by means of a double reflection of light from the two at least partially reflective surfaces.

A preferred embodiment of the invention will now be described in detail with reference to the accompanying drawing, in which.

Figure 1:
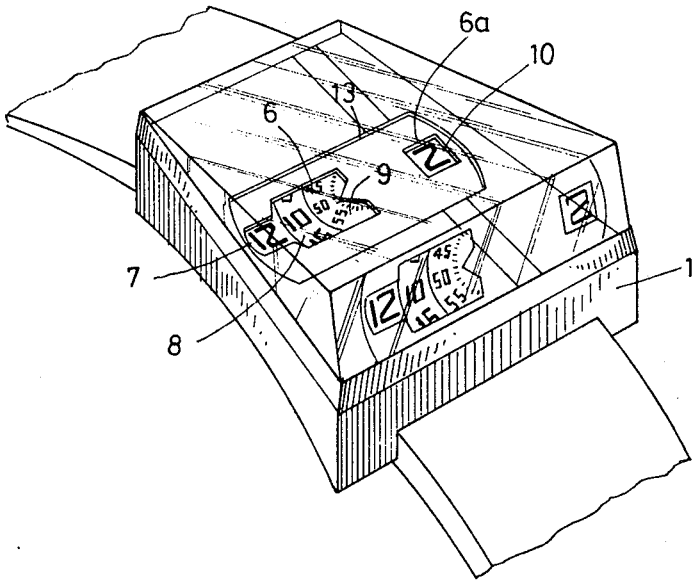
FIG. 1 is a perspective view.
Figure 2:
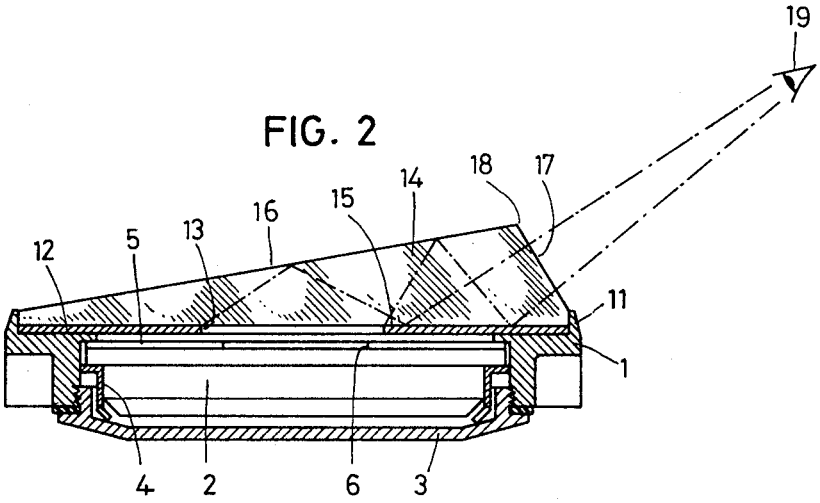
FIG. 2 is a simplified section taken on a central longitudinal plane.

The timepiece illustrated in FIGS. 1 and 2 is a wrist-watch having a case comprising a caseband 1 of a generally trapezoidal shape with a circular central opening therein surrounding an operating assembly 2, which in this particular case is a mechanical watch movement. Screwed to caseband 1 is a circular back cover 3. The movement is held within the case by a resilient casing-ring 4, the inner rim of which presses the edge of a dial 5 against a flange of caseband 1. Dial 5 is of a generally circular shape and has two apertures 6 and 6*a* in its central portion. Indicator members driven by operating assembly 2 are fitted between a bottom plate and dial 5. They comprise concentric rings and disks bearing digital indications at their peripheries. Thus an hour-indicator 7, a minute-indicator 8, a seconds-indicator 9, and a date-indicator 10 may be seen in FIG. 1. The upper portion of caseband 1 comprises a rim 11 which serves, firstly, for positioning a trapezoidal plate 12 having a central rectangular opening 13 with rounded ends, exposing dial 5 and apertures 6 and 6*a*, and secondly, for securing a crystal 14, e.g., by setting. Crystal 14 rests upon plate 12. Its shape in section is shown in FIG. 2. It constitutes a prism having a flat base surface 15 engaged within rim 11, a second flat surface 16 inclined at an angle of about 15° to 20° with respect to base 15 starting from the left-band end thereof as viewed in FIG. 2, and a third flat surface 17 inclined at an angle on the order of 70° to 75° with respect to base 15 and forming with surface 16 a straight upper edge 18 of crystal 14. The latter may be made of any transparent material customarily used for manufacturing watch crystals, i.e., either of an inorganic material such as mineral glass, sapphire, or transparent crystals of another kind, or of an organic material such as a transparent plastic, for example. The two longitudinal side surfaces are preferably perpendicular to the plane of the watch.

It is essential to note that plate 12 has a uniform upper metallic surface displaying reflective or diffusive properties so that when base 15 of crystal 14 is laid on that surface, light rays are reflected in a proportion of more than 50%. However, plate 12 might also be eliminated providing the upper surface of caseband 1 and dial 5 have the required reflective or diffusive properties.

It will be understood upon considering FIGS. 1 and 2 that an observer facing in the direction indicated by the position of his eye 19 in FIG. 2, and who is looking at the inclined surface 17, sees by means of a double reflection the entirety of the two apertures 6 and 6*a* and the indications of the time appearing therein. The directions and paths of the two extreme rays of his angle of vision are shown in FIG. 2. Owing to the surface properties of plate 12, the reflection on base 15 of crystal 14 in front of opening 13 is almost perfect, while the reflection on inclined surface 16, although partial, is still clearly sufficient to ensure a distinct and precise view of the indicator members. In order to improve the reflective effect still further, it would, of course, be possible to treat surface 16 as well by coating it with a very thin metallic layer which, without appreciably diminishing the transparency of crystal 14, would intensify its reflectiveness. The display device is, as a matter of fact, normally visible through crystal 14 to anyone looking at it from above; and plate 12, even though treated so as to have a uniform appearance, e.g., by gilding, may bear a decoration and, for instance, the trademark of the watch. However, plate 12 might also be replaced by a reflective metallic coating applied to all or just part of the inner face of crystal 14.

In each case, the geometry of the crystal should be designed as a function of the size and arrangement of the case, and of the display device, also taking into account the coefficient of refraction of the material of which the crystal is made, so that the display device appears in surface 17, to anyone looking at that surface perpendicular to its plane, after a double reflection, the second of which is produced on the base of the prism in front of the display device proper.

In still another embodiment, the inclined front surface 17 might be curved so as to produce a lens effect and show the display device enlarged. Instead of being a single, solid part, crystal 14 might also be made up of a number of thin elements, the space within even being filled with a transparent liquid.

Instead of the ring or disk display mechanism comprising hour, minute, second and date indicators 7, 8, 9, 10, operating assembly 2 might comprise, in another embodiment, a display mechanism having hands, e.g., in a ladies' watch design, the hands being of a short length so as to occupy only the central portion of the visible face of the case. The operating assembly 2 might also consist of an electronic module energizing a digital display device utilizing light-emitting diodes or a liquid crystal, for example. Finally, the arrangement described could equally well be applied to timepieces other than wrist-watches, in particular to alarm clocks, e.g., flat-shaped alarm clocks, or to miniature clocks. Experience has shown that in all the aforementioned cases, the presence of a crystal having two surface forming an acute angle between them and providing a double reflection of light rays, and a third surface through which the display device is visible after this double reflection, has made is possible to produce a display of novel appearance which is easy and convenient to read.

What is claimed is:

1. A timepiece comprising a case having an opening therein, an operating assembly disposed within said case, a flat display device exposed through said opening, and a crystal closing off said opening, wherein said crystal comprises two partially reflective surfaces enclosing between them an angle of less than 45°, and a third surface through which said display device is visible by means of a double reflection of light from said two partially reflective surfaces.

2. A timepiece according to claim 1, wherein said crystal takes the form of a prism having at least three faces, a first said face forming a base of said prism and extending parallel to said display device, a second said face being slightly inclined with respect to said base and extending thereover from one end thereof, and a third said face also being inclined with respect to said base and extending thereover from the other end thereof.

3. A timepiece according to claim 2, wherein said display device occupies, within said opening in said case, an area smaller than the surface area covered by said crystal and is surrounded by a reflective surface of uniform appearance in contact with said base of said prism for rendering said prism reflective.

4. A timepiece according to claim 1 taking the form of a wrist-watch.

5. A timepiece according to claim 4 having a substantially rectangular shape.

6. A timepiece according to claim 1, further comprising a dial having one or more apertures, wherein said display device is a digital display mechanism comprising indicator members rotating about an axis, bearing indications of time, and being partially visible in said one or more apertures.

7. A timepiece according to claim 6, wherein said crystal comprises a base, said timepiece further comprising a metallic plate having an opening and being situated between said dial and said base, said dial being exposed through said opening in the region of said one or more apertures.

8. A timepiece according to claim 1, wherein said display device is a digital display device.

* * * * *